US009599035B2

(12) United States Patent
Saito et al.

(10) Patent No.: US 9,599,035 B2
(45) Date of Patent: Mar. 21, 2017

(54) ACCELERATOR APPARATUS

(71) Applicant: DENSO CORPORATION, Kariya, Aichi-pref. (JP)

(72) Inventors: Takehiro Saito, Anjo (JP); Masahiro Makino, Hanoi (VN); Hiroshi Saji, Okazaki (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/666,971

(22) Filed: Mar. 24, 2015

(65) Prior Publication Data

US 2015/0275776 A1 Oct. 1, 2015

(30) Foreign Application Priority Data

Mar. 25, 2014 (JP) ..... 2014-61754

(51) Int. Cl.
*G05G 1/30* (2008.04)
*F02D 11/10* (2006.01)
*G05G 5/05* (2006.01)

(52) U.S. Cl.
CPC ..... *F02D 11/106* (2013.01); *G05G 5/05* (2013.01); *F02D 2200/602* (2013.01); *Y10T 74/2054* (2015.01)

(58) Field of Classification Search
CPC ..... F02D 11/106; G05G 5/05
USPC ..... 74/513
See application file for complete search history.

(56) References Cited

U.S. PATENT DOCUMENTS 7,012,423 B2 * 3/2006 Hasegawa ..... G05G 1/38 324/207.25
7,216,563 B2 * 5/2007 Willemsen ..... G05G 1/38 74/512
8,161,842 B2 * 4/2012 Kim ..... B60K 26/021 74/513
2007/0240534 A1 * 10/2007 Makino ..... B60K 26/021 74/513
2013/0133466 A1 * 5/2013 Inuzuka ..... G05G 5/03 74/513
2013/0186228 A1 7/2013 Saito et al.
2014/0000408 A1 * 1/2014 Saito ..... G05G 1/44 74/513
2014/0096639 A1 * 4/2014 Saito ..... G05G 1/44 74/513
2015/0007684 A1 * 1/2015 Saito ..... G05G 1/44 74/513
2015/0176505 A1 * 6/2015 Viet ..... F02D 11/02 74/514

FOREIGN PATENT DOCUMENTS

JP A-2008-184108 8/2008

* cited by examiner

*Primary Examiner* — Vicky Johnson
(74) *Attorney, Agent, or Firm* — Nixon & Vanderhye P.C.

(57) ABSTRACT

A pedal spring urges a pedal spring receiving portion to rotate a manipulation member in an accelerator closing direction. The pedal spring has an end portion that contacts a first contact surface of a front segment. A hysteresis spring urges a hysteresis spring receiving portion, which is engaged with the manipulation member, in the accelerator closing direction. The hysteresis spring has an end portion that contacts a second contact surface of the front segment. A step surface is formed between the first contact surface and the second contact surface to limit movement of the end portion of the hysteresis spring.

4 Claims, 5 Drawing Sheets

ACCELERATOR APPARATUS

CROSS REFERENCE TO RELATED APPLICATION

This application is based on and incorporates herein by reference Japanese Patent Application No. 2014-61754 filed on Mar. 25, 2014.

TECHNICAL FIELD

The present disclosure relates to an accelerator apparatus.

BACKGROUND

A known accelerator apparatus controls an acceleration state of a vehicle according to the amount of depression of an accelerator pedal, which is depressed by a foot of a driver of the vehicle. In this accelerator apparatus, a rotational angle of a rotatable shaft, which corresponds to a rotational angle of a pedal arm having the accelerator pedal connected thereto, is sensed. In the vehicle, an opening degree of a throttle valve, which adjusts a quantity of intake air drawn into an internal combustion engine of the vehicle, is determined based on the sensed rotational angle.

A return mechanism and a hysteresis mechanism are received in an interior space of a support member of the accelerator apparatus. The return mechanism urges the rotatable shaft toward an accelerator closing direction. The hysteresis mechanism makes a pedal force, which is applied to an accelerator pedal at the time of depressing the accelerator pedal, to be larger than a pedal force, which is applied to the accelerator pedal at the time of releasing the accelerator pedal. The return mechanism includes a return spring that urges a pedal boss portion, which is fixed to an outer wall of the rotatable shaft and is rotatable integrally with the rotatable shaft, in the accelerator closing direction. Furthermore, the hysteresis mechanism includes a hysteresis spring that urges a hysteresis boss portion, which is engaged with the pedal boss portion and is rotatably placed on a radially outer side of the rotatable shaft, in the accelerator closing direction. For example, JP2013-147211A (corresponding to US2013/0186228A1) discloses an accelerator apparatus that has a return spring and a hysteresis spring, which are received in an inside of a support member such that the return spring and the hysteresis spring are arranged side-by-side and extend in a top-to-bottom direction.

In the accelerator apparatus of JP2013-147211A (corresponding to US2013/0186228A1), one end of the return spring and one end of the hysteresis spring contact an inner wall of the support member. In the inner wall of the support member, a guide, which is in a form of a projection, is formed between a first contact surface, which contacts one end of the return spring, and a second contact surface, which contacts one end of the hysteresis spring. The guide is formed to be relatively large to implement a sufficient strength for limiting positional deviation of the return spring and a positional deviation of the hysteresis spring. Thus, in the accelerator apparatus of JP2013-147211A (corresponding to US2013/0186228A1), which has the first contact surface, the guide in the form of the projection, and the second contact surface that are arranged one after another in the top-to-bottom direction, a size of the support member in the top-to-bottom direction becomes disadvantageously large.

SUMMARY

The present disclosure addresses the above disadvantage. According to the present disclosure, there is provided an accelerator apparatus that includes a support member, a shaft, a pedal boss portion, a pedal portion, a pedal-side urging member receiving portion, a first friction member, a pedal-side urging member, a hysteresis boss portion, a hysteresis-side urging member receiving portion, a second friction member, a hysteresis-side urging member, and a rotational angle sensing device. The support member is installable to a body of a vehicle. The shaft is rotatably supported by the support member. The pedal boss portion is fixed to an outer wall of the shaft and is rotatable integrally with the shaft. The pedal portion extends from the pedal boss portion to an outside of the support member. The pedal portion is depressable by a driver of the vehicle. The pedal-side urging member receiving portion extends from the pedal boss portion. The first friction member is placed between the pedal boss portion and the support member. When the pedal boss portion is rotated in an accelerator opening direction, the first friction member is urged against an inner wall of the support member. The pedal-side urging member has one end portion, which is engaged with the pedal-side urging member receiving portion, and another end portion, which contacts a first contact surface formed in the inner wall of the support member. The pedal-side urging member urges the pedal-side urging member receiving portion to rotate the pedal boss portion in an accelerator closing direction that is opposite from the accelerator opening direction. The hysteresis boss portion is engaged with the pedal boss portion and is rotatably placed on a radially outer side of the shaft. When the pedal boss portion is rotated in the accelerator opening direction, a distance between the pedal boss portion and the hysteresis boss portion is increased. The hysteresis-side urging member receiving portion extends from the hysteresis boss portion in a direction that coincides with an extending direction of the pedal-side urging member receiving portion. The second friction member is placed between the hysteresis boss portion and the support member. When the pedal boss portion is rotated in the accelerator opening direction, the second friction member is urged against the inner wall of the support member. The hysteresis-side urging member has one end portion, which is engaged with the hysteresis-side urging member receiving portion, and another end portion, which contacts a second contact surface formed in the inner wall of the support member. The hysteresis-side urging member urges the hysteresis-side urging member receiving portion to rotate the hysteresis boss portion in the accelerator closing direction. The rotational angle sensing device senses a rotational angle of the shaft relative to the support member. One of the pedal-side urging member and the hysteresis-side urging member contacts a step surface formed between the first contact surface and the second contact surface.

BRIEF DESCRIPTION OF THE DRAWINGS

The drawings described herein are for illustration purposes only and are not intended to limit the scope of the present disclosure in any way.

DETAILED DESCRIPTION

Figure 1:
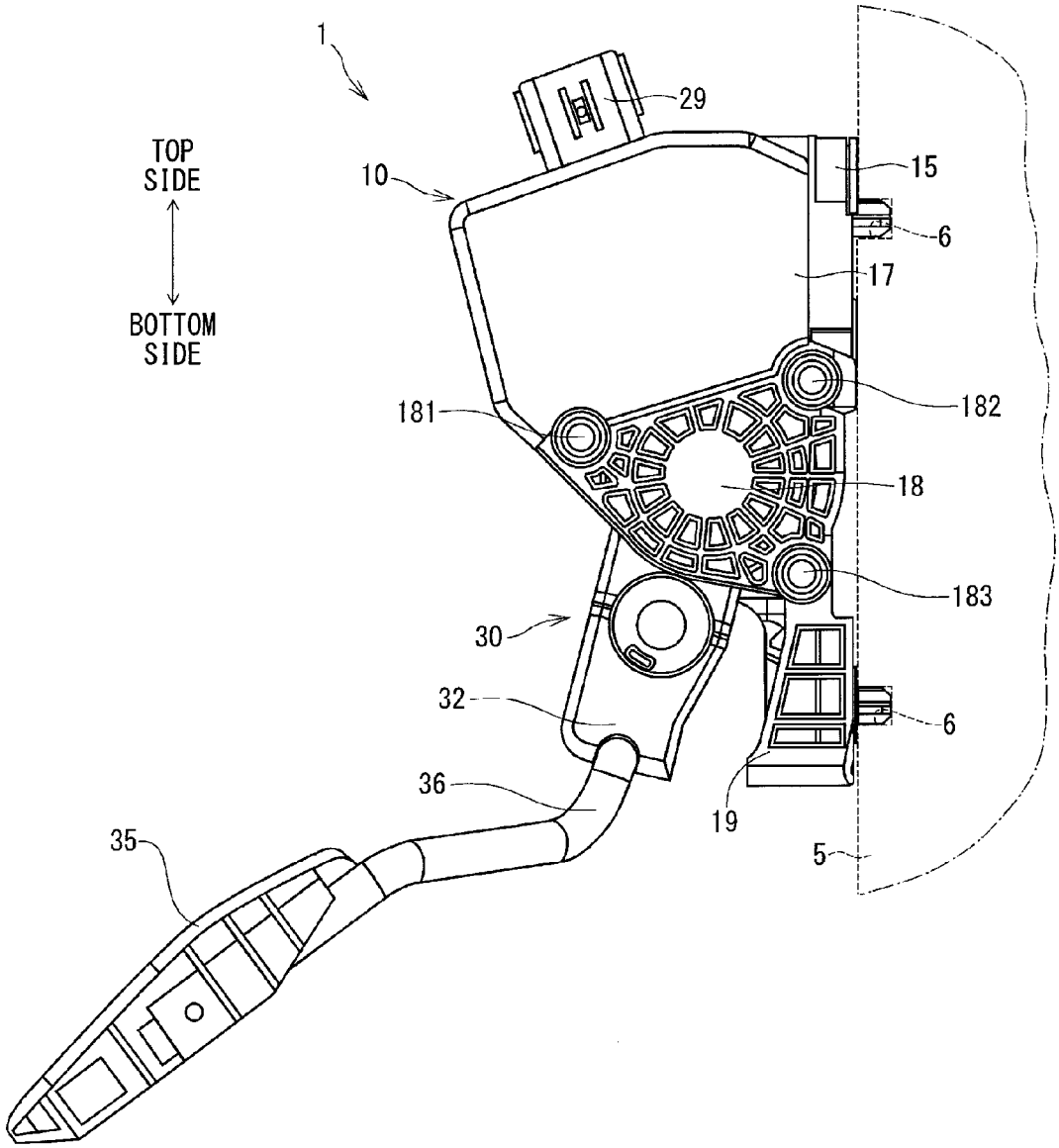
FIG. 1 is a schematic view of an accelerator apparatus according to a first embodiment of the present disclosure.

Various embodiments of the present disclosure will be described with reference to the accompanying drawings.

First Embodiment

FIGS. 1 to 5 show an accelerator apparatus according to a first embodiment of the present disclosure. The accelerator apparatus 1 is an input apparatus, which is manipulated by a driver of a vehicle (e.g., an automobile) to determine a valve opening degree of a throttle valve of an internal combustion engine of the vehicle. The accelerator apparatus 1 is an electronic accelerator apparatus and transmits an electric signal, which indicates the amount of depression of an accelerator pedal 35, to an electronic control device. The electronic control device drives the throttle valve through a throttle actuator (not shown) based on the amount of depression of the accelerator pedal 35 and the other information.

The accelerator apparatus 1 includes a support member 10, a shaft 20, a manipulation member 30, a pedal spring (serving as a pedal-side urging member) 39, a rotational angle sensor (serving as a rotational angle sensing device or a rotational angle sensing means) 25 and a hysteresis mechanism 40. In the following description, a top side of FIGS. 1 to 4 will be described as a top side (an upper side) of the accelerator apparatus 1, and a bottom side of FIGS. 1 to 4 will be described as a bottom side (a lower side) of the accelerator apparatus 1.

The support member 10 includes a housing 12, a first cover 17 and a second cover 18. The support member 10 forms an internal space 11, which receives the shaft 20, the pedal spring 39, the rotational angle sensor 25 and the hysteresis mechanism 40. A communication hole 111 is formed at a lower side of the support member 10 to communicate between the internal space 11 and the outside of the support member 10. The communication hole 111 corresponds to a movable range of the manipulation member 30.

The housing 12 is made of a resin material and includes a bearing segment 13, a front segment 16, a rear segment 15 and a top segment 14. The front segment 16 is connected to the bearing segment 13 and is located at a front side of the accelerator apparatus 1, at which a pedal arm 36 of the accelerator apparatus 1 projects. The rear segment 15 is opposed to the front segment 16. The top segment 14 is located at a top side of the accelerator apparatus 1 and connects between the front segment 16 and the rear segment 15.

Figure 2:
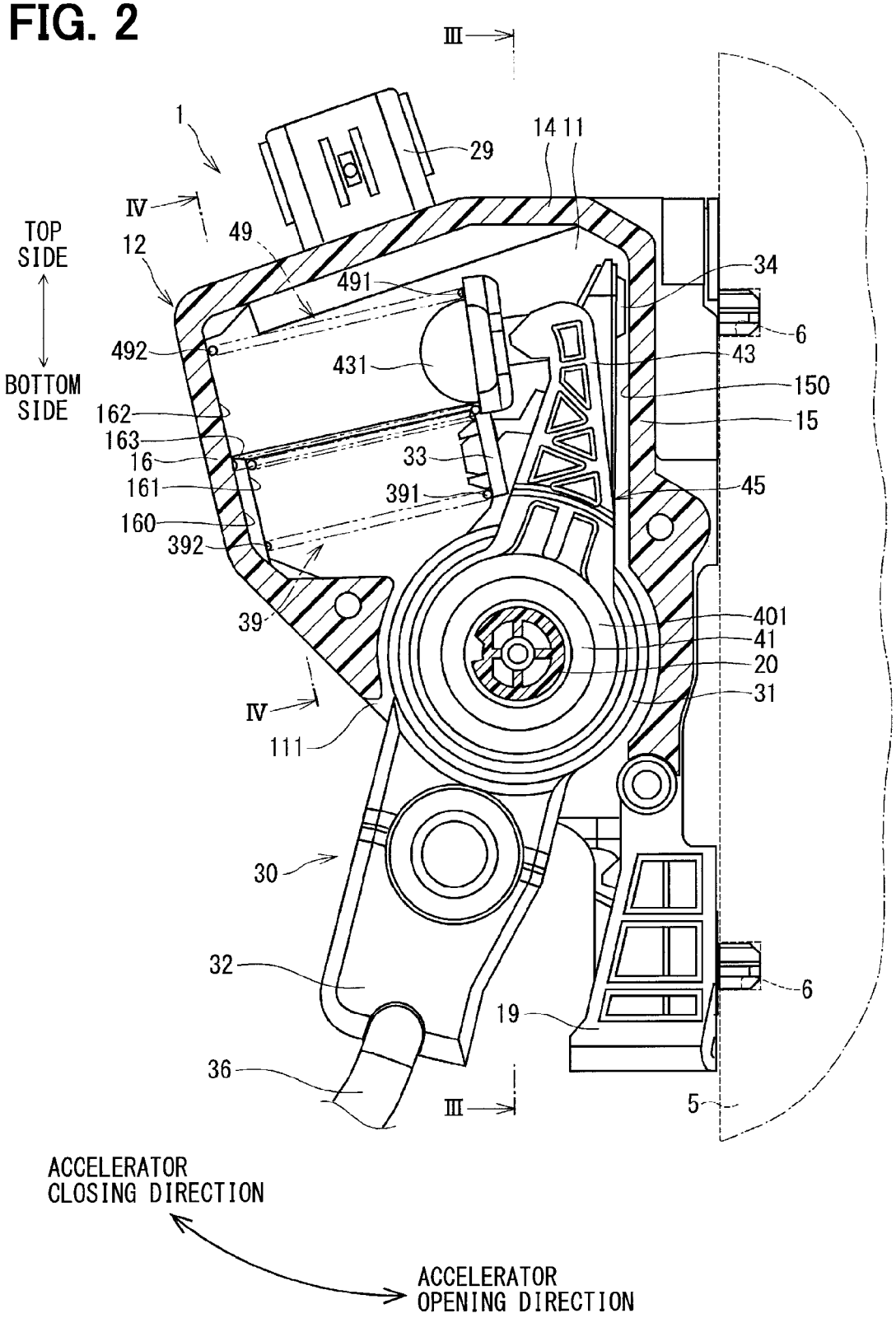
FIG. 2 is a cross-sectional view of the accelerator apparatus of the first embodiment.
Figure 3:
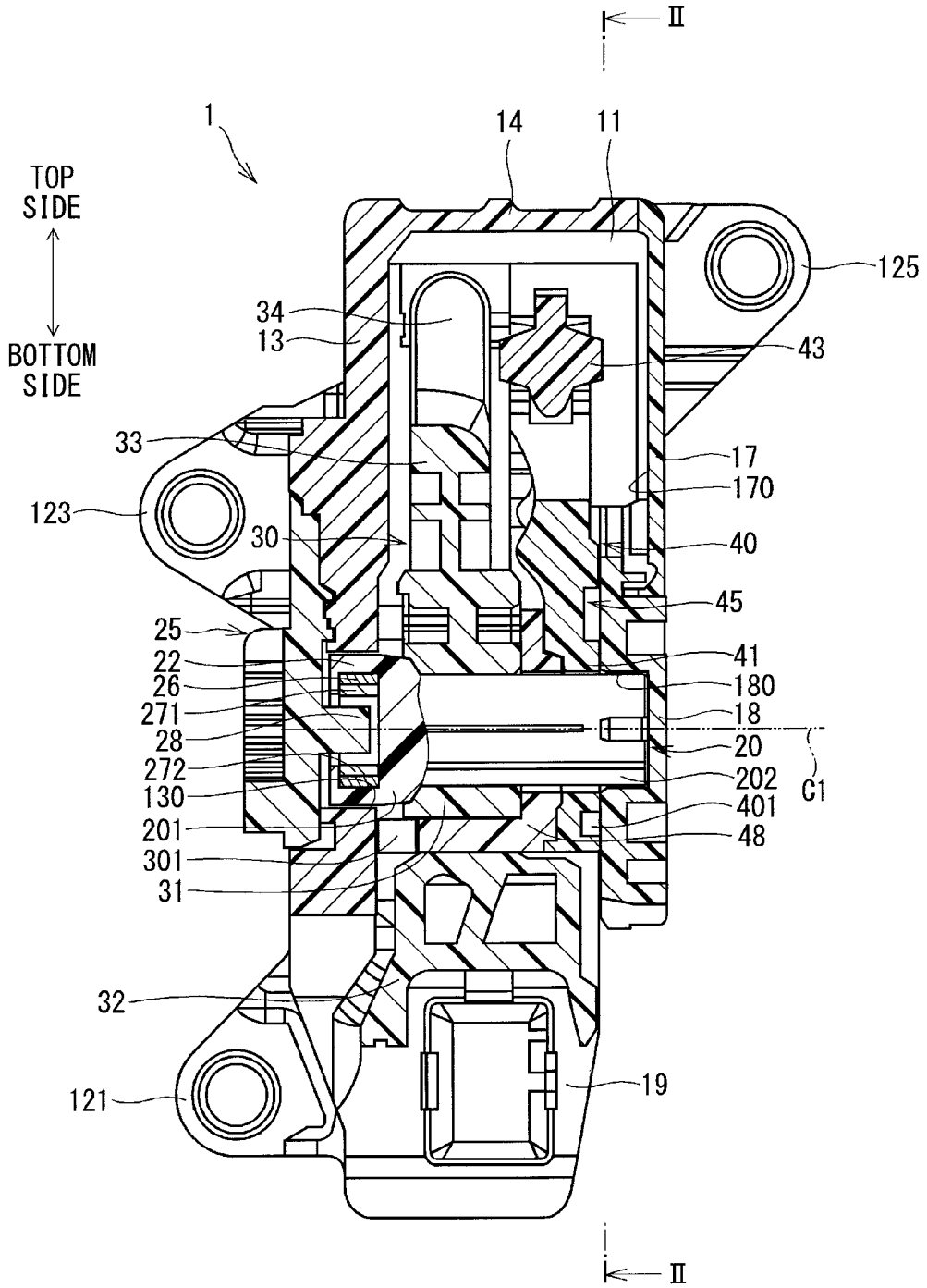
FIG. 3 is a cross sectional view taken along line III-III in FIG. 2.

As shown in FIG. 3, the housing 12 has three housing bases 121, 123, 125. A projection is formed in each of the housing bases 121, 123, 125. The projections of the housing bases 121, 123, 125 project from the housing bases 121, 123, 125 in a common direction. The accelerator apparatus 1 is installed to the body 5 of the vehicle by fitting these three projections of the housing bases 121, 123, 125 into fitting holes 6 formed in the body 5 of the vehicle (see FIGS. 1 and 2).

The bearing segment 13 has an opening, through which one end portion 201 of the shaft 20 is inserted. The shaft 20 is rotatably received in the opening of the bearing segment 13. Specifically, the inner wall of the opening of the bearing segment 13 forms a bearing 130, which rotatably supports the one end portion 201 of the shaft 20.

A full-opening-side stopper portion 19 is formed in the lower side of the rear segment 15, as indicated in FIGS. 1 to 3. When the full-opening-side stopper portion 19 contacts the manipulation member 30, the full-opening-side stopper portion 19 limits further rotation of the manipulation member 30 and the shaft 20, which are rotatable integrally. The accelerator-full-opening position is a position, at which the amount of depression of the manipulation member 30 by the driver is in the full amount, i.e., the accelerator opening degree is 100% (full opening).

A first contact surface 161 and a second contact surface 162 are formed in an inner wall 160 of the front segment 16. The pedal spring 39 contacts the first contact surface 161, and a hysteresis spring (serving as a hysteresis-side urging member) 49 contacts the second contact surface 162. The first contact surface 161 is placed closer to the rear segment 15 in comparison to the second contact surface 162. In other words, as shown in FIG. 2, the first contact surface 161 is placed on one side of the second contact surface 162, at which the rear segment 15 is placed, in a front-to-rear direction of the vehicle (a direction perpendicular to the rotational axis of the shaft 20). A step surface (also referred to as a transition surface or a sloped surface) 163 is formed between the first contact surface 161 and the second contact surface 162.

The first cover 17 and the second cover 18 are opposed to the bearing segment 13 and are generally parallel to the bearing segment 13.

The first cover 17 is configured into a rectangular plate form. The first cover 17 is engaged with the second cover 18. The first cover 17 also contacts the top segment 14, the rear segment 15, and an end portion of the front segment 16 opposite from a side connected to the bearing segment 13. The first cover 17 limits intrusion of foreign objects (e.g., debris) into the internal space 11.

Figure 4:
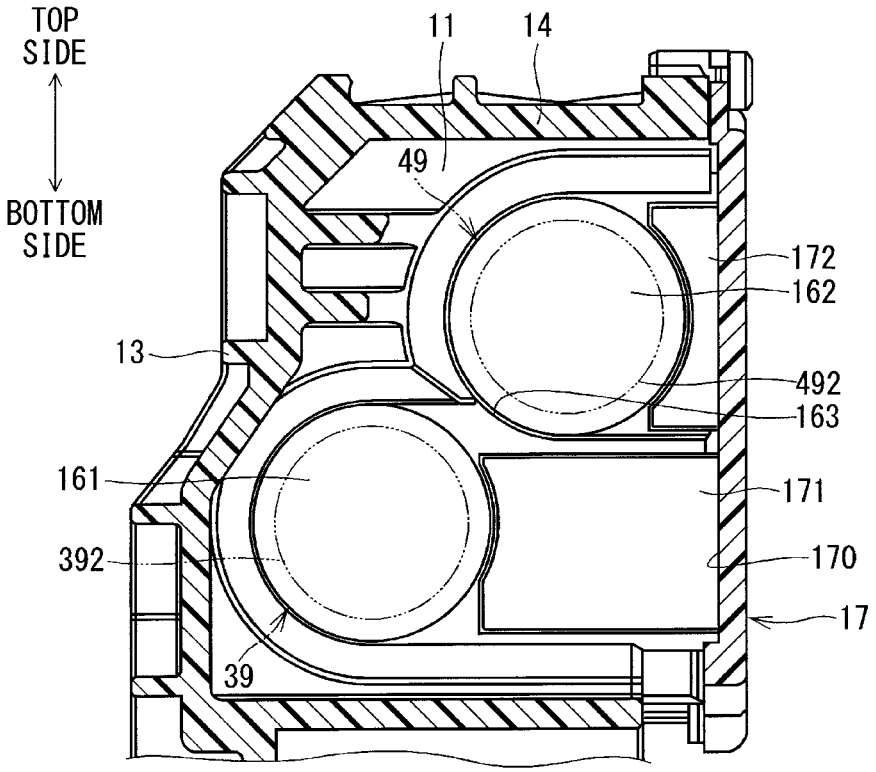
FIG. 4 is a cross sectional view taken along line VI-VI in FIG. 2.
Figure 5:
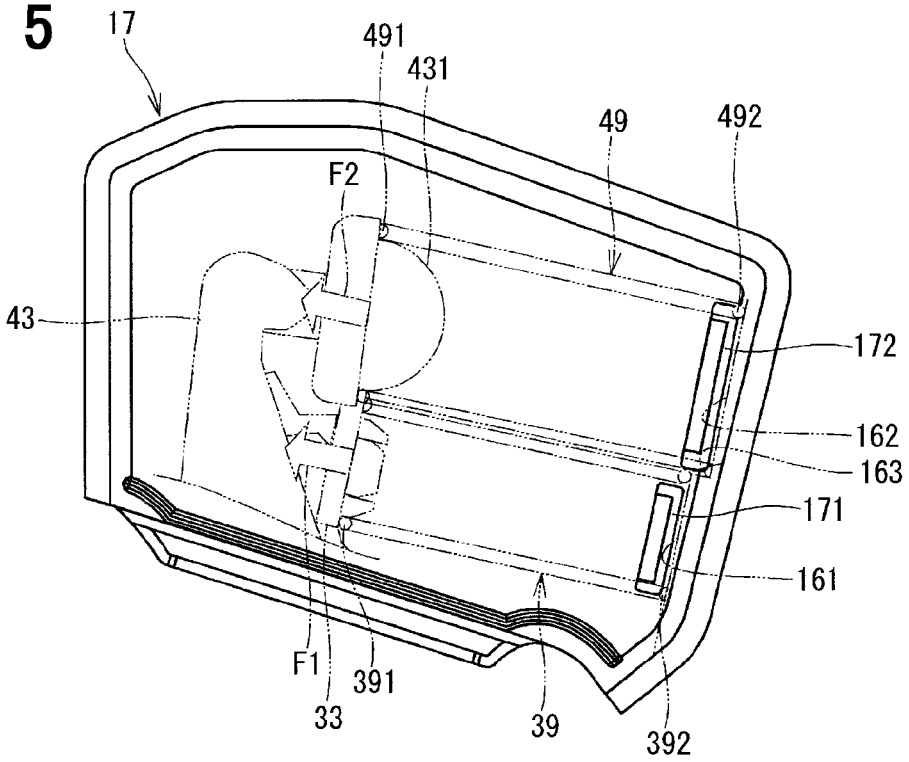
FIG. 5 is a schematic view of a first cover of the accelerator apparatus of the first embodiment.

As shown in FIGS. 4 and 5, two spring limiting portions are formed in an inner wall 170 of the first cover 17, which is located on the internal space 11 side. Specifically, as shown in FIG. 4, a pedal spring limiting portion (a pedal-side urging member limiting portion) 171, which is located at a lower side of the first cover 17, contacts a side surface of the other end portion 392 of the pedal spring 39, which is located on a side where the first cover 17 is placed. A hysteresis spring limiting portion (serving as a hysteresis-side urging member limiting portion) 172, which is located at an upper side of the first cover 17, contacts a side surface of the other end portion 492 of the hysteresis spring 49, which is located on a side where the first cover 17 is placed.

A positional relationship between the pedal spring limiting portion 171 and the hysteresis spring limiting portion 172 will be described with reference to FIG. 5. FIG. 5 shows a schematic diagram of the internal space 11 of the first cover 17. In FIG. 5, the pedal spring 39, the hysteresis spring 49, a pedal spring receiving portion (serving as a pedal-side urging member receiving portion) 33, a hysteresis spring receiving portion (a hysteresis-side urging member receiving portion) 43, the first contact surface 161, the second contact surface 162, and the step surface 163 are indicated by a dot-dot-dash line for the sake of easy understanding of the positional relationships of these components. The pedal spring 39 and the hysteresis spring 49 respectively contact the pedal spring limiting portion 171 and the hysteresis spring limiting portion 172 upon assembling of the first cover 17 and the housing 12 together. The pedal spring receiving portion 33 and the hysteresis spring receiving portion 43 respectively support the pedal spring 39 and the hysteresis spring 49. The first contact surface 161, the second contact surface 162, and the step surface 163 are formed in the front segment 16.

As shown in FIG. 5, the pedal spring limiting portion 171 is formed along the first contact surface 161. The hysteresis spring limiting portion 172 is formed along the second contact surface 162. Thereby, a location of the pedal spring limiting portion 171 and a location of the hysteresis spring limiting portion 172 are displaced from each other in a direction that coincides with (that is parallel to) an urging direction of the pedal spring 39 and an urging direction of the hysteresis spring 49, i.e., in a direction of a blank arrow F1 and a direction of a blank arrow F2 shown in FIG. 5.

The second cover 18 is formed into a triangular plate form. The second cover 18 is fixed to an end portion of the rear segment 15 and an end portion of the front segment 16, which are opposite from a side were the bearing segment 13 is placed, by bolts 181, 182, 183. The second cover 18 has a recess, into which the other end portion 202 of the shaft 20 is inserted. Specifically, an inner wall of the recess forms a bearing 180, which rotatably supports the other end portion 202 of the shaft 20. Protrusions and recesses, which are configured into a mesh pattern, are formed in an outer wall of the second cover 18. The second cover 18 limits intrusion of foreign objects (e.g., debris) into the internal space 11.

The shaft 20 extends in a horizontal direction (a left-to-right direction of the vehicle) at the lower side of the accelerator apparatus 1. A sensor receiving recess 22 is formed in the one end portion 201 of the shaft 20 to receive a sensing device of the rotational angle sensor 25.

The shaft 20 is rotatable through a predetermined angular range from an accelerator-full-closing position to an accelerator-full-opening position in response to a torque, which is applied from the manipulation member 30 upon depressing of the manipulation member 30 by a foot of the driver. The accelerator-full-closing position is a position, at which the amount of depression of the manipulation member 30 by the foot of the driver is zero, i.e., the accelerator opening degree is 0% (full closing).

Hereinafter, with reference to FIG. 2, the rotational direction of the manipulation member 30 from the accelerator-full-closing position toward the accelerator-full-opening position will be referred to an accelerator opening direction. Furthermore, the rotational direction of the manipulation member 30 from the accelerator-full-opening position toward the accelerator-full-closing position will be referred to an accelerator closing direction.

The manipulation member 30 includes a pedal boss portion 31, an arm connecting portion 32, the pedal spring receiving portion (serving as the pedal-side urging member receiving portion) 33, a full-closing-side stopper portion 34, the accelerator pedal 35 and the pedal arm 36. The arm connecting portion 32, the accelerator pedal 35, and the pedal arm 36 cooperate with each other to serve as a pedal portion.

The pedal boss portion 31 is configured into an annular form and is placed between the bearing segment 13 and the second cover 18. The pedal boss portion 31 is fixed to an outer wall (outer peripheral wall) of the shaft 20 by, for example, press fitting.

First-bevel-gear teeth (not shown) are formed to a side surface of the pedal boss portion 31, which is located on a side where the second cover 18 is placed. The first-bevel-gear teeth are arranged one after another at equal intervals in the circumferential direction. An axial projecting length of each of the first-bevel-gear teeth, which project toward a hysteresis rotatable member 45 of the hysteresis mechanism 40, circumferentially progressively increases in the accelerator closing direction. Furthermore, a sloped surface is formed in a distal end part of each of the first-bevel-gear teeth such that the sloped surface of each of the first-bevel-gear teeth progressively approaches the hysteresis rotatable member 45 in the accelerator closing direction.

A first friction member 301 is provided to a side surface of the pedal boss portion 31, which is located on a side where the housing 12 is placed. The first friction member 301 is configured into an annular form and is placed on a radially outer side of the shaft 20 such that the first friction member 301 is located between the pedal boss portion 31 and the inner wall of the bearing segment 13. When the pedal boss portion 31 is urged in a direction away from the hysteresis rotatable member 45, i.e., in a direction toward the bearing segment 13, the pedal boss portion 31 is frictionally engaged with the first friction member 301. A frictional force between the pedal boss portion 31 and the first friction member 301 becomes a rotational resistance of the pedal boss portion 31.

One end part of the arm connecting portion 32 is connected to an outer surface of the pedal boss portion 31, which is located at a radially outer side, and the other end part of the arm connecting portion 32 extends to the outside of the support member 10 through the communication hole 111.

One end part of the pedal spring receiving portion 33 is connected to a side surface of the pedal boss portion 31 located at a radially outer side, and the other end part of the pedal spring receiving portion 33 extends upwardly in the internal space 11. One end portion 391 of the pedal spring 39 is engaged with the pedal spring receiving portion 33.

The full-closing-side stopper portion 34 extends from the pedal spring receiving portion 33 toward the upper side in the internal space 11. When the full-closing-side stopper portion 34 contacts the inner wall 150 of the rear segment 15, the rotation of the manipulation member 30 in the accelerator closing direction is limited at the accelerator-full-closing position.

The accelerator pedal 35 is connected to one end portion of the pedal arm 36. The other end portion of the pedal arm 36 is fixed to the arm connecting portion 32. The accelerator pedal 35 converts the depression of the accelerator pedal 35, which is made by the driver of the vehicle, into a rotational torque about the rotational axis C1 of the shaft 20, and this converted rotational torque is conducted to the shaft 20.

When the accelerator pedal 35 is rotated in the accelerator opening direction, a rotational angle of the shaft 20 in the accelerator opening direction relative to the accelerator-full-closing position, which serves as a reference point, is increased. Thereby, the accelerator opening degree, which corresponds to this rotational angle, is also increased. Furthermore, when the accelerator pedal 35 is rotated in the accelerator closing direction, the rotational angle of the shaft 20 is reduced, and thereby the accelerator opening degree is reduced.

The pedal spring 39 is, for example, a coil spring. The other end portion 392 of the pedal spring 39 contacts the first contact surface 161 of the front segment 16. The pedal spring 39 urges the manipulation member 30 in the accelerator closing direction. The urging force, which is exerted from the pedal spring 39 to the manipulation member 30, is increased when the rotational angle of the manipulation member 30, i.e., the rotational angle of the shaft 20 is increased. Furthermore, this urging force is set to enable returning of the manipulation member 30 and the shaft 20 to the accelerator-full-closing position regardless of the rotational position of the manipulation member 30.

The rotational angle sensor 25 includes a yoke 26, two permanent magnets (the permanent magnets having different polarities, respectively) 271, 272 and a Hall element 28. The yoke 26 is made of a magnetic material and is configured into a tubular form. The yoke 26 is fixed to an inner wall of the sensor receiving recess 22 of the shaft 20. The magnets 271, 272 are placed radially inward of the yoke 26 and are fixed to the inner wall of the yoke 26 such that the magnets 271, 272 are opposed to each other about the rotational axis C1 of the shaft 20. The Hall element 28 is placed between the magnet 271 and the magnet 272. The rotational angle sensor 25 serves as the rotational angle sensing device or the rotational angle sensing means of the present disclosure.

When a magnetic field is applied to the Hall element 28, through which an electric current flows, a voltage is generated in the Hall element 28. A density of a magnetic flux, which penetrates through the Hall element 28, changes when the shaft 20 and the magnets 271, 272 are rotated about the rotational axis C1 of the shaft 20. A value of the generated voltage is substantially proportional to the density of the magnetic flux, which penetrates through the Hall element 28. The rotational angle sensor 25 senses the relative rotational angle between the Hall element 28 and the magnets 271, 272, i.e., the relative rotational angle of the shaft 20 relative to the support member 10 by sensing the voltage, which is generated in the Hall element 28. The rotational angle sensor 25 transmits an electrical signal, which indicates the sensed rotational angle, to the external electronic control device (not shown) through an external connector 29 that is provided in the upper part of the accelerator apparatus 1.

The hysteresis mechanism 40 includes the hysteresis rotatable member 45, an intermediate member 48, a second friction member 401, and a hysteresis spring 49. A hysteresis boss portion 41 and a hysteresis spring receiving portion 43 are formed integrally in the hysteresis rotatable member 45.

The hysteresis boss portion 41 is located on a radially outer side of the shaft 20 and is axially placed between the pedal boss portion 31 and the inner wall of the second cover 18. The hysteresis boss portion 41 is configured into an annular form and is rotatable relative to the shaft 20 and the pedal boss portion 31. Furthermore, the hysteresis boss portion 41 is axially movable toward or away from the pedal boss portion 31.

The hysteresis spring receiving portion 43 extends upward from the hysteresis boss portion 41 in the internal space 11. The hysteresis spring receiving portion 43 includes an engaging part 431 at an end portion of the hysteresis spring receiving portion 43 that is opposite from a side connected to the hysteresis boss portion 41. One end portion 491 of the hysteresis spring 49 is engaged to the engaging part 431. A surface of the engaging part 431, which contacts an end part of the hysteresis spring receiving portion 43, is configured into a generally semispherical shape. Thereby, the urging force of the hysteresis spring 49 is conducted to the hysteresis spring receiving portion 43 without being influenced by an angle of the hysteresis spring 49.

The intermediate member 48 is axially placed between the hysteresis boss portion 41 and the pedal boss portion 31. The intermediate member 48 is rotatable integrally with the hysteresis rotatable member 45 relative to the shaft 20 and the pedal boss portion 31. The intermediate member 48 is axially movable toward or away from the pedal boss portion 31.

Second-bevel-gear teeth (not shown) are formed integrally with a side surface of the intermediate member 48, which is located on a side where the pedal boss portion 31 is placed. The second-bevel-gear teeth are arranged one after another at equal intervals in the circumferential direction. An axial projecting length of each of the second-bevel-gear teeth, which project toward the pedal boss portion 31, circumferentially progressively increases in the accelerator opening direction. Furthermore, a sloped surface is formed in a distal end part of each of the second-bevel-gear teeth such that the sloped surface of each of the second-bevel-gear teeth progressively approaches the hysteresis boss portion 41 in the accelerator opening direction.

the sloped surface of each of the first-bevel-gear teeth contacts the sloped surface of a corresponding one of the second-bevel-gear teeth, so that the first-bevel-gear teeth and the second-bevel-gear teeth can conduct the rotation between the pedal boss portion 31 and the intermediate member 48 as well as the hysteresis boss portion 41. Specifically, the rotation of the pedal boss portion 31 in the accelerator opening direction can be conducted to the hysteresis boss portion 41 through the first-bevel-gear teeth and the second-bevel-gear teeth. Furthermore, the rotation of the hysteresis boss portion 41 in the accelerator closing direction can be conducted to the pedal boss portion 31 through the second-bevel-gear teeth and the first-bevel-gear teeth.

When the rotational position of the pedal boss portion 31 is on a side of the accelerator-full-closing position, at which the accelerator-full-opening position is placed, the sloped surface of each of the first-bevel-gear teeth and the sloped surface of the corresponding one of the second-bevel-gear teeth are engaged with each other such that the pedal boss portion 31 is urged toward the housing 12 side (the left side in FIG. 3), and the intermediate member 48 and the hysteresis boss portion 41 are urged toward the second cover 18 side (the right side in FIG. 3) away from the pedal boss portion 31. At this time, when the rotational angle of the pedal boss portion 31 from the accelerator-full-closing position is increased, an urging force of the first-bevel-gear teeth, which urges the pedal boss portion 31 toward the housing 12 side (the left side in FIG. 3), is increased. Furthermore, when the rotational angle of the pedal boss portion 31 from the accelerator-full-closing position is increased, an urging force of the second-bevel-gear teeth, which urges the hysteresis boss portion 41 toward the second cover 18 side (the right side in FIG. 3), is increased. Also, when the pedal boss portion 31 is rotated in the accelerator opening direction, a distance between the pedal boss portion 31 and the hysteresis boss portion 41 is increased.

The second friction member 401 is configured into an annular form and is axially placed between the hysteresis rotatable member 45 and the inner wall of the second cover 18 on the radially outer side of the shaft 20. When the hysteresis rotatable member 45 is urged in the direction away from the pedal boss portion 31, i.e., in the direction toward the second cover 18, the hysteresis rotatable member 45 is frictionally engaged with the second friction member 401. A frictional force between the hysteresis rotatable member 45 and the second friction member 401 becomes a rotational resistance of the hysteresis rotatable member 45.

The hysteresis spring 49 is, for example, a coil spring. The other end portion 492 of the hysteresis spring 49 contacts the second contact surface 162 of the front segment 16. As shown in FIGS. 2 and 4, the hysteresis spring 49 and the pedal spring 39 overlap with each other in the horizontal direction (a direction parallel to the shaft 20).

The hysteresis spring 49 urges the hysteresis rotatable member 45 in the accelerator closing direction. The urging force of the hysteresis spring 49 is increased when the rotational angle of the hysteresis boss portion 41 is increased. Furthermore, a torque, which is applied to the hysteresis boss portion 41 by the urging force of the hysteresis spring 49, is conducted to the pedal boss portion 31 through the second-bevel-gear teeth and the first-bevel-gear teeth.

Next, an assembling method of the accelerator apparatus 1 will be described.

First of all, the manipulation member 30, which is installed to the shaft 20, is assembled with the housing 12. Next, the pedal spring 39 is installed between the pedal spring receiving portion 33 and the front segment 16 in an installation direction of the first cover 17 to the housing 12. At this time, the one end portion 391 of the pedal spring 39 is engaged with the pedal spring receiving portion 33, and the other end portion 392 of the pedal spring 39 contacts the first contact surface 161.

Next, the shaft 20, which is installed to the housing 12 along with the manipulation member 30, is assembled with the hysteresis rotatable member 45. Thereafter, the hysteresis spring 49 is installed between the hysteresis spring receiving portion 43 and the front segment 16 in the installation direction of the first cover 17 to the housing 12. At this time, the one end portion 491 of the hysteresis spring 49 is engaged with the engaging part 431, and the other end portion 492 of the hysteresis spring 49 contacts the second contact surface 162.

Next, the housing 12 is assembled with the first cover 17 and the second cover 18. At this time, the pedal spring limiting portion 171 contacts the side surface of the other end portion 392 of the pedal spring 39, which is located on the side where the first cover 17 is placed, and the hysteresis spring limiting portion 172 contact the side surface of the other end portion 492 of the hysteresis spring 49, which is located on the side where the first cover 17 is placed.

Finally, the rotational angle sensor 25 is assembled to the outer wall of the bearing segment 13, and thereby the assembling of the accelerator apparatus 1 is completed.

Next, the operation of the accelerator apparatus 1 will be described.

When the accelerator pedal 35 is depressed by the foot of the driver, the manipulation member 30 is rotated together with the shaft 20 in the accelerator opening direction about the rotational axis C1 of the shaft 20 in response to the pedal force of the driver applied to the accelerator pedal 35. At this time, it is necessary to apply the pedal force of the driver that generates a torque larger than a sum of a torque, which is generated by the urging forces of the pedal spring 39 and the hysteresis spring 49, and a resistance torque, which is generated by the frictional forces of the first friction member 301 and the second friction member 401.

For example, in order to maintain the depressed state of the accelerator pedal 35 after the depressing of the accelerator pedal 35 with the foot of the driver of the vehicle, the driver may apply the pedal force that generates the torque larger than a difference between the torque, which is generated by the urging forces of the pedal spring 39 and the hysteresis spring 49, and the resistance torque, which is generated by the frictional forces of the first friction member 301 and the second friction member 401. In other words, when the driver wants to maintain the depressed state of the accelerator pedal 35 after the depressing of the accelerator pedal 35, the driver may reduce the applied pedal force by a certain amount.

Furthermore, at the time of returning the depressed accelerator pedal 35 toward the accelerator-full-closing position, the driver may apply the pedal force that generates the torque smaller than the difference between the torque, which is generated by the urging forces of the pedal spring 39 and the hysteresis spring 49, and the resistance torque, which is generated by the frictional forces of the first friction member 301 and the second friction member 401. Here, at the time of quickly returning the accelerator pedal 35 to the accelerator-full-closing position, it is only required to stop the depressing of the accelerator pedal 35. Therefore, there is no substantial burden on the driver. In contrast, at the time of gradually returning the accelerator pedal 35 to the accelerator-full-closing position, it is required to apply a predetermined pedal force on the accelerator pedal 35. At this time, the pedal force, which is required to gradually return the accelerator pedal 35 toward the accelerator-full-closing position, is relatively small.

In the accelerator apparatus 1 of the first embodiment, the step surface 163 is formed between the first contact surface 161, to which the other end portion 392 of the pedal spring 39 contacts, and the second contact surface 162, to which the other end portion 492 of the hysteresis spring 49 contacts. At the time of installing the hysteresis spring 49 between the hysteresis spring receiving portion 43 and the front segment 16, the other end portion 492 of the hysteresis spring 49 contacts the step surface 163 and is placed at a predetermined location of the second contact surface 162. In this way, in the accelerator apparatus 1 of the first embodiment, the movement of the hysteresis spring 49 can be limited without a need for providing a dedicated guide (an additional guide), which limits movement of the other end portion 492 of the hysteresis spring 49, at the location between the first contact surface 161 and the second contact surface 162. Furthermore, since the guide, which limits the movement of the other end portion 492 of the hysteresis spring 49, is not necessary, the pedal spring 39 and the hysteresis spring 49 can overlap with each other in the horizontal direction (the direction parallel to the shaft 20), as shown in FIG. 4. In this way, the size of the support member 10, particularly the size of the support member 10 in the top-to-bottom direction can be reduced.

Furthermore, the pedal spring limiting portion 171, which guides the pedal spring 39 to the corresponding predetermined location, and the hysteresis spring limiting portion 172, which guides the hysteresis spring 49 to the corresponding predetermined location, are formed in the first cover 17. The pedal spring limiting portion 171 and the hysteresis spring limiting portion 172 are formed to correspond with the positional difference between the first contact surface 161 and the second contact surface 162 and to correct the deviation in the installation position of the other end portion 392 of the pedal spring 39 and the deviation in the installation position of the other end portion 492 of the hysteresis spring 49 at the time of assembling the accelerator apparatus 1. In this way, each of the pedal spring 39 and the hysteresis spring 49 can contact the corresponding predetermined location.

Second Embodiment

Figure 6:
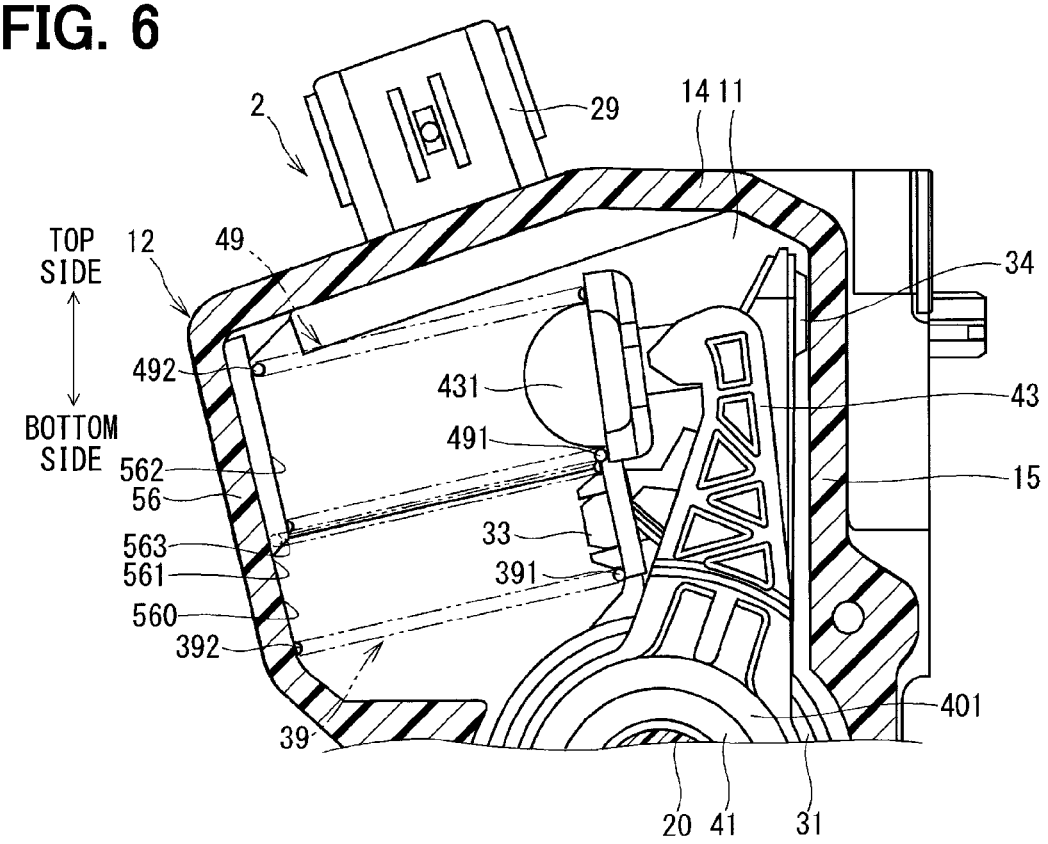
FIG. 6 is a cross-sectional view of an accelerator apparatus according to a second embodiment of the present disclosure.

Next, the accelerator apparatus according to a second embodiment of the present disclosure will be described with reference to FIG. 6. The second embodiment differs from the first embodiment with respect to the positional relationship between the first contact surface and the second contact surface. In the following description, components, which are similar to those of the first embodiment, will be indicated by the same reference numerals and will not be described further.

In the accelerator apparatus 2 of the second embodiment, a first contact surface 561, to which the other end portion 392 of the pedal spring 39 contacts, and a second contact surface 562, to which the other end portion 492 of the hysteresis spring 49 contacts, are formed in the inner wall 560 of the front segment 56. The second contact surface 562 is placed closer to the rear segment 15 in comparison to the first contact surface 561. In other words, the second contact surface 562 is placed on one side of the first contact surface 561, at which the rear segment 15 is placed, in the front-to-rear direction of the vehicle (the direction perpendicular to the rotational axis of the shaft 20). A step surface (also referred to as a transition surface or a sloped surface) 563 is formed between the first contact surface 561 and the second contact surface 562, and the other end portion 392 of the pedal spring 39 contacts the step surface 563.

In the accelerator apparatus 2 of the second embodiment, the movement of the other end portion 392 of the pedal spring 39 is limited by the step surface 563 that is formed between the first contact surface 561 and the second contact surface 562. Therefore, in the second embodiment, the advantages, which are similar to those of the first embodiment, are achieved.

Now, modifications of the above embodiments will be described.

(A) In the above embodiments, the first cover forms the pedal spring limiting portion and the hysteresis spring limiting portion. Alternatively, the pedal spring limiting portion and the hysteresis spring limiting portion may be eliminated. Further alternatively, only one of the pedal spring limiting portion and the hysteresis spring limiting portion may be provided in the first cover.

(B) In the above embodiments, the pedal spring limiting portion is formed along the first contact surface, and the hysteresis spring limiting portion is formed along the second contact surface. The location of the pedal spring limiting portion is displaced from the location of the hysteresis spring limiting portion in the direction that coincides with (i.e., that is parallel to) the application direction of the urging force of the pedal spring and the application direction of the hysteresis spring. However, the location of the pedal spring limiting portion and the location of the hysteresis spring limiting portion are not limited to these locations.

The present disclosure is not limited to the above embodiments, and the above embodiments may be modified within the spirit and scope of the present invention.

What is claimed is:

1. An accelerator apparatus comprising:

a support member that is installable to a body of a vehicle;

a shaft that is rotatably supported by the support member;

a pedal boss portion that is fixed to an outer wall of the shaft and is rotatable integrally with the shaft;

a pedal portion that extends from the pedal boss portion to an outside of the support member, wherein the pedal portion is depressable by a driver of the vehicle;

a pedal-side urging member receiving portion that extends from the pedal boss portion;

a first friction member that is placed between the pedal boss portion and the support member, wherein the first friction member is configured to be urged against an inner wall of the support member by rotation of the pedal boss portion in an accelerator opening direction;

a pedal-side urging member that has one end portion, which is engaged with the pedal-side urging member receiving portion, and another end portion, which contacts a first contact surface formed in the inner wall of the support member, wherein the pedal-side urging member urges the pedal-side urging member receiving portion to rotate the pedal boss portion in an accelerator closing direction that is opposite from the accelerator opening direction;

a hysteresis boss portion that is engaged with the pedal boss portion and is rotatably placed on a radially outer side of the shaft, wherein a distance between the pedal boss portion and the hysteresis boss portion is configured to be increased by rotation of the pedal boss portion in the accelerator opening direction;

a hysteresis-side urging member receiving portion that extends from the hysteresis boss portion in a direction that coincides with an extending direction of the pedal-side urging member receiving portion;

a second friction member that is placed between the hysteresis boss portion and the support member, wherein the second friction member is configured to be urged against the inner wall of the support member by rotation of the pedal boss portion in the accelerator opening direction;

a hysteresis-side urging member that has one end portion, which is engaged with the hysteresis-side urging member receiving portion, and another end portion, which contacts a second contact surface formed in the inner wall of the support member, wherein the hysteresis-side urging member urges the hysteresis-side urging member receiving portion to rotate the hysteresis boss portion in the accelerator closing direction, and a distance between the hysteresis-side urging member and the shaft is larger than a distance between the pedal-side urging member and the shaft; and a rotational angle sensing device that senses a rotational angle of the shaft relative to the support member, wherein:

the first contact surface is displaced from the second contact surface in a direction that is perpendicular to a plane of the second contact surface to form a step surface, which connects between the first contact surface and the second contact surface;

one of the pedal-side urging member and the hysteresis-side urging member contacts the step surface; and the support member includes:

a housing that includes the first contact surface, the second contact surface and the step surface and rotatably supports one end portion of the shaft; and a cover that rotatably supports another end portion of the shaft and includes:

a pedal-side urging member limiting portion that projects from one side, at which the other end portion of the shaft is placed, toward an opposite side, at which the one end portion of the shaft is placed, wherein the pedal-side urging member limiting portion limits movement of the other end portion of the pedal-side urging member; and a hysteresis-side urging member limiting portion that projects from the one side, at which the other end portion of the shaft is placed, toward the opposite side, at which the one end portion of the shaft is placed, while a length of the hysteresis-side urging member limiting portion, which is measured from the one side toward the opposite side, is smaller than a length of the pedal-side urging member limiting portion, which is measured from the one side toward the opposite side, wherein the hysteresis-side urging member limiting portion limits movement of the other end portion of the hysteresis-side urging member; and a location of the pedal-side urging member limiting portion and a location of the hysteresis-side urging member limiting portion are displaced from each other in a direction that coincides with an urging direction of the pedal-side urging member and an urging direction of the hysteresis-side urging member.

2. The accelerator apparatus according to claim 1, wherein:

the shaft extends in a horizontal direction; and the pedal-side urging member and the hysteresis-side urging member overlap with each other in the horizontal direction.

3. The accelerator apparatus according to claim 1, wherein the first contact surface, the second contact surface and the step surface are continuously and seamlessly formed in the inner wall of the support member.

4. The accelerator apparatus according to claim 1, wherein:

a projecting end portion of the pedal-side urging member limiting portion, which projects toward the opposite side and is opposed to the other end portion of the pedal-side urging member, is arcuately curved to contact with an arcuate outer peripheral surface of the other end portion of the pedal-side urging member; and a projecting end portion of the hysteresis-side urging member limiting portion, which projects toward the opposite side and is opposed to the other end portion of the hysteresis-side urging member, is arcuately curved to contact with an arcuate outer peripheral surface of the other end portion of the hysteresis-side urging member.

* * * * *